US007063227B2

(12) United States Patent
Looker

(10) Patent No.: US 7,063,227 B2
(45) Date of Patent: Jun. 20, 2006

(54) AIR CARGO CONTAINER

(75) Inventor: Robert Looker, El Segundo, CA (US)

(73) Assignee: Satco, Inc., El Segundo, CA (US)

( * ) Notice: Subject to any disclaimer, the term of this patent is extended or adjusted under 35 U.S.C. 154(b) by 219 days.

(21) Appl. No.: 10/655,890

(22) Filed: Sep. 5, 2003

(65) Prior Publication Data

US 2005/0051544 A1 Mar. 10, 2005

(51) Int. Cl.
*B65D 88/14* (2006.01)
*B65D 43/12* (2006.01)
*A47H 3/00* (2006.01)

(52) U.S. Cl. ..... 220/345.1; 220/1.5; 220/350; 160/269; 206/816

(58) Field of Classification Search ..... 220/1.5, 220/345.1, 350; 206/816; 160/264, 265, 160/269, 270, 271, 273.1; 312/297
See application file for complete search history.

(56) References Cited

U.S. PATENT DOCUMENTS 262,312 A * 8/1882 Rearden ..... 312/280
467,035 A * 1/1892 Livingston ..... 312/50
1,370,500 A * 3/1921 Jones ..... 160/23.1
1,784,166 A * 12/1930 Washington ..... 312/289
2,722,469 A * 11/1955 Kosovsky ..... 312/310
3,051,232 A * 8/1962 Lamb ..... 160/368.1
3,768,540 A * 10/1973 McSwain ..... 160/23.1
3,904,064 A * 9/1975 Looker ..... 220/1.5
4,046,277 A * 9/1977 Morrison ..... 220/1.5
4,108,517 A * 8/1978 Tomalinas et al. ..... 312/297
4,428,491 A 1/1984 Mittelmann et al.
D276,578 S * 12/1984 Kwiecinski ..... D14/440
4,538,663 A 9/1985 Looker
4,574,968 A 3/1986 Mittelmann
D286,126 S * 10/1986 Driscoll ..... D7/609
4,802,600 A 2/1989 Bretschneider
5,109,998 A 5/1992 Bretschneider
5,180,078 A 1/1993 Looker
5,186,231 A * 2/1993 Lewis ..... 160/310
5,217,132 A 6/1993 Looker
5,242,070 A 9/1993 Bretschneider et al.
5,601,201 A 2/1997 Looker
D471,380 S * 3/2003 King et al. ..... D6/441
6,591,555 B1 * 7/2003 King et al. ..... 52/36.5
6,685,251 B1 * 2/2004 Dumas ..... 296/100.01

* cited by examiner

*Primary Examiner*—Nathan J. Newhouse
*Assistant Examiner*—James Smalley
(74) *Attorney, Agent, or Firm*—Perkins Coie LLP

(57) ABSTRACT

An air cargo container includes a base, two side walls, and a rear wall. The side walls each included a curved front edge. A retractable or roll-up door is located between the side walls. The door is extendible from an open position in which the door is retracted or rolled-up, to a closed position in which the door follows the curved front edges of the side walls and terminates at a position adjacent to the base. A support member is attached along the curved front edge of each of the side walls. The support members each include a channel for receiving a cable on a side edge of the retractable door. One or more levers on each support member are rotatable from an open position to a closed position in which the levers secure the cables within the channels in the support members.

13 Claims, 7 Drawing Sheets

Fig. 7
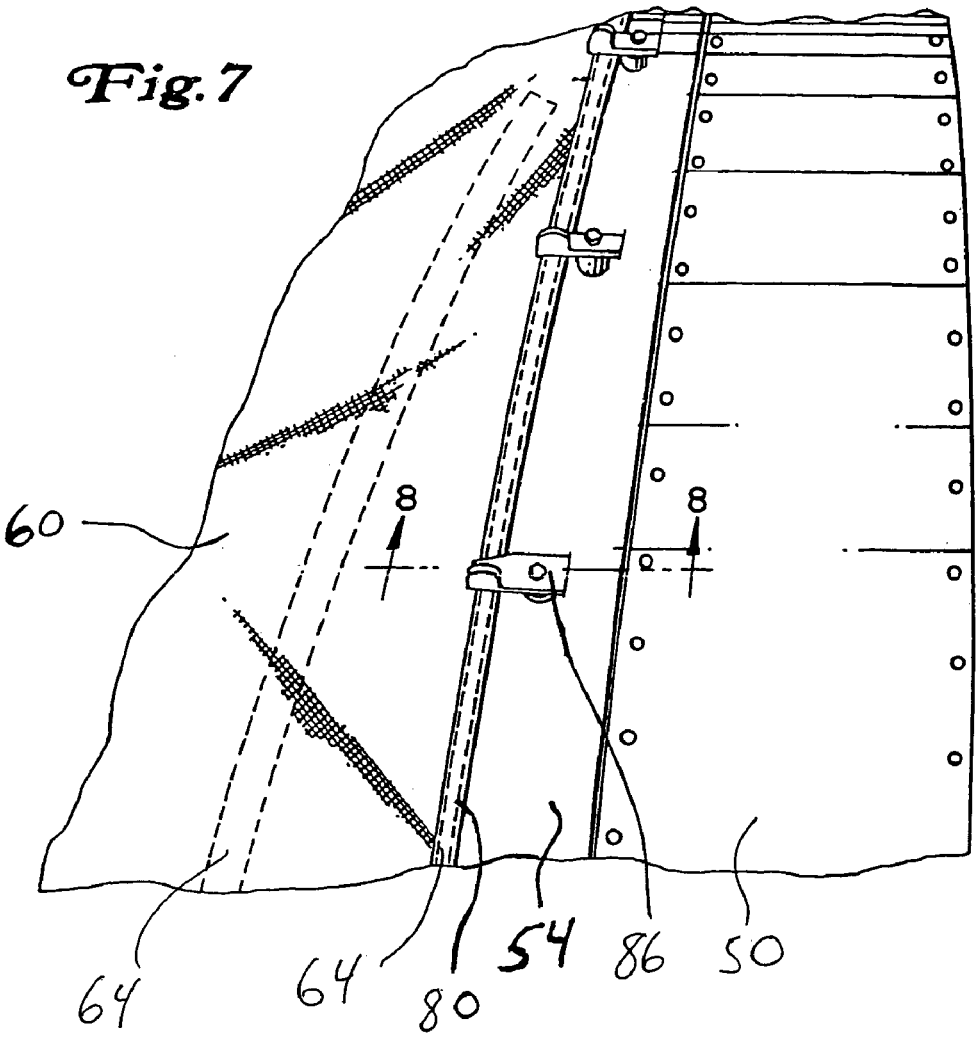
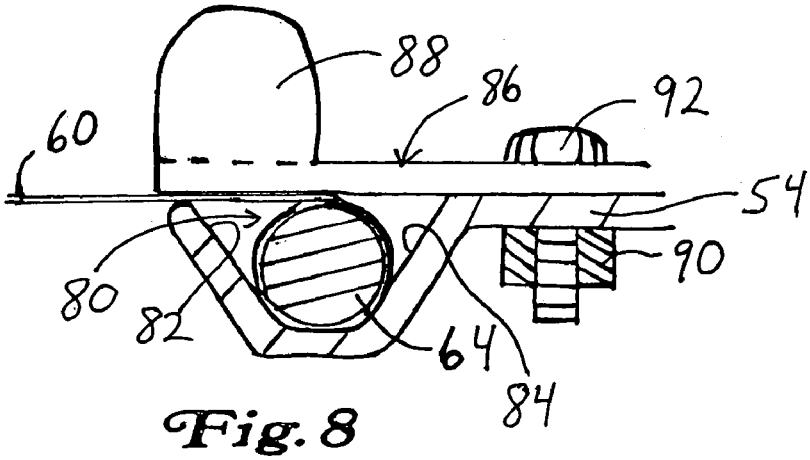
Fig. 8

AIR CARGO CONTAINER

BACKGROUND OF THE INVENTION

Air cargo containers have been used for the transportation of cargo by aircraft for many years. Cargo such as cartons, smaller shipping containers, etc. is first loaded into containers. The containers are then loaded into an aircraft. Use of air cargo containers is much faster than loading cargo directly into the cargo space of the aircraft, since the individual cartons need not be separately placed and secured within the aircraft. The air cargo containers can also be loaded at locations remote from the airport. Furthermore, because the cargo containers are typically designed and constructed to correspond to the interior dimensions of the aircraft cargo space, the containers fit more securely in the cargo space and do not shift during flight. These and other advantages of air cargo containers have made air cargo containers widely used in the air freight and airline industry.

As with most equipment used on aircraft, two primary design goals for air cargo containers are that they be both strong and lightweight. A typical air cargo container includes a base which is typically a flat rectangular aluminum pallet. Two side walls, a rear wall, a front wall, and a roof or lid are attached to the base. The front or outside wall is typically curved to match the curvature of the fuselage of a cargo plane. For the purposes of explanation only, the curved side of the container is referred to here as the front side or wall, and the opposite and flat side is referred here as the back side.

A door is typically included in the flat vertical rear wall of the container so that cargo may be loaded into, and unloaded out of, the container. As illustrated in the prior art container 10 of FIG. 1, a roll-up door 16 is used to close off the flat rear side of the cargo container 10. The roll-up door moves straight up and down. When cargo 12 is loaded from the rear toward the front curved wall 14 of the container 10, the cargo 12 can generally be loaded flat against the front wall only up to the height where the curvature begins, designated by dimension A in FIG. 1, typically about 36–60, 40–56, 44–52 inches. Since the cargo 12 generally consists primarily of square or rectangular boxes, much of the useable space under the curved section of the wall 14 of the air cargo container 10 is not usable.

In response to this problem, air cargo containers have been developed that include a flexible door in the curved front wall of the container. These flexible doors typically include netting that is buckled together, using several straps and buckles, both horizontally and vertically along the flexible door opening. The bottom ends of the horizontal straps are secured to the pallet with standard aircraft pallet fittings. A weather cover is incorporated into the netting. The weather cover is typically split along a centerline of the container.

By using a flexible door on the front side of the air cargo container, cargo items may be loaded against the vertical rear wall of the container up to the top of the rear wall. Cargo may continue to be loaded up to the front of the container. The curved space in the container may be substantially filled smaller items, thus filling more of the available space within the container.

While this flexible door design allows more space in the air cargo container to be filled, it has several drawbacks. Initially, the straps and buckles on the netting and cover take a relatively long time to fasten together. Typically, three to four minutes are required to close a container using the flexible door design. In addition, the air cargo container does not include a storage area for the netting and the cover when they are in the open position. Thus, the netting and cover can fall in front of the opening, during loading or unloading. They may also move freely under windy conditions, causing damage to themselves or to the cargo or the container.

Moreover, if cargo shifts during transport, it can lodge against the netting, causing tension in the netting and the belts. If there is significant tension in the netting and/or belts, opening the flap door can be difficult or even dangerous. Finally, because the flexible door is made of netting, it cannot act as a template or indicator that no cargo is protruding out of container and may cause interference when the container is loaded onto an aircraft. Cargo items can protrude through openings in the netting. Thus, the air cargo container cannot always be fully loaded, since determining whether the flexible door is within the profile necessary for safe loading into the aircraft, must be estimated visually.

Therefore, an air cargo container that may be efficiently loaded and unloaded through a curved side of the air cargo container is needed.

SUMMARY OF INVENTION

The invention is directed to an air cargo container having a retractable or roll-up door on a curved surface of the container. The door is advantageously made of a flexible material so that it can follow the curvature of the curved surface of the container. With a roll-up door on the curved side, the container can be opened and closed quickly, and cargo can be loaded to substantially fill the entire container. The door can also be retracted or rolled up and stored during loading and unloading of cargo. The door can also act as a cargo loading template, to avoid having cargo protrude out of the container.

In a first aspect, an air cargo container includes a retractable or roll-up door located between first and second side walls, each having a curved front edge. The door is extendible or deployable from a rolled up or retracted position, where the container is open, to a deployed or extended position in which the door follows the curved front edges of the first and second side walls, and the container is closed. The door terminates at a position adjacent to the base when in the closed position.

In a second aspect, a support member is attached along the curved front edge of each of the first and second side walls. The support members, preferably aluminum extrusions, each include a channel for receiving a cable on a side edge of the retractable or roll-up door. The cables are typically sewn into the sides of the door cover.

In a third aspect, each support member includes one or more levers or tabs. Each lever is moveable from an open position, to a closed position in which the lever secures the cable within the channel in the support member.

In a fourth aspect, a door bar is attached to a leading or bottom edge of the door. The bar is securable to the side walls, the base, and/or the support members for maintaining the door in the closed position. End plates are preferably attached to each end of the elongate bar for engaging buttons or pins mounted to the side walls.

In a fifth aspect, a method of loading a cargo container having a curved front end and a flat rear wall includes the steps of: loading cargo items against an interior surface of the vertical rear wall until the vertical rear wall is at least substantially covered by the cargo items; loading additional cargo items into the cargo container until the cargo container is substantially filled with cargo items; pulling a retractable door down along the curved front end such that cables on side edges of the door are positioned within channels in the curved front end; sequentially turning levers on the curved front end to cover the cables and secure the cables within the channels; pulling a leading edge of the door down to a position adjacent to a base of the cargo container; and securing the door into a closed position.

Other features and advantages of the invention will appear hereinafter. The features of the invention described above can be used separately or together, or in various combinations of one or more of them. The invention resides as well in sub-combinations of the features described.

BRIEF DESCRIPTION OF THE DRAWINGS

In the drawings, wherein the same reference number denotes the same element, throughout the several views:

FIG. 7 is a partial perspective view of a support member on the air cargo container of FIGS. 1–6 including levers holding a door cable into a channel in a door frame extrusion on the support member.

FIG. 8 is a section view of the support member, cable, and door frame extrusion of FIG. 7 taken along line 8—8 in FIG. 7.

DETAILED DESCRIPTION OF THE DRAWINGS

The invention is directed to an air cargo container having a curved front end with a retractable door for covering an opening in the curved front end. The retractable door follows the curvature of the front end, such that the shape of the front end of the air cargo container substantially matches the curvature of an aircraft fuselage. Other features described herein may enhance, but are not essential to, the invention.

Figure 2:
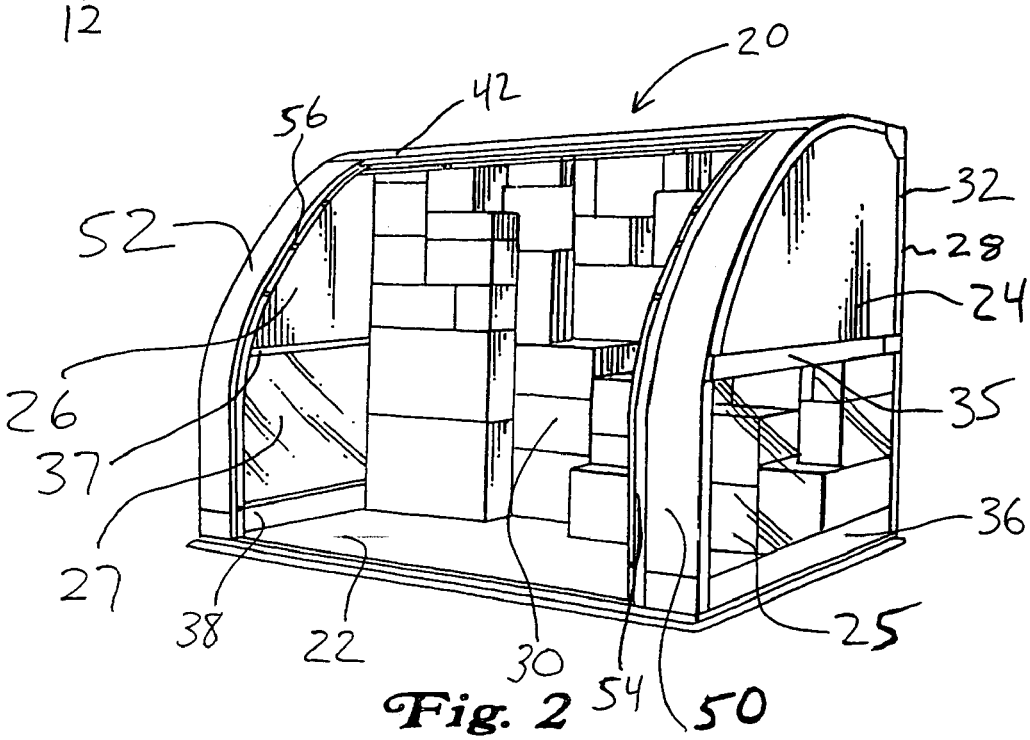
FIG. 2 is a perspective view of an air cargo container according to the present invention with a retractable or roll-up door in a retracted (open) position.

Turning to the drawings, FIG. 2 illustrates an air cargo container 20 in an open position according to a preferred embodiment. The air cargo container 20 includes a base 22, a first side wall 24, a second side wall 26, and a rear wall 28 (not visible in FIG. 2). Unless otherwise specified, the components of the air cargo container 20 are preferably constructed of aluminum, or another suitable material providing requisite structural strength, while remaining relatively lightweight. The aluminum components are preferably riveted, welded, bolted, etc., to form the container.

In the air cargo container 20 illustrated in FIGS. 2–6, transparent sheets 25, 27, 29, which are preferably made from a polycarbonate material or other suitable transparent material, are included on a lower section of each of the first and second side walls 24, 26 and the rear panel 28, respectively. The transparent sheets 25, 27, 29 facilitate quick visual inspection of the air cargo container 20 for determining whether the container 20 is loaded with cargo 30. The transparent sheets 25, 27, 29 may alternatively be positioned at any other suitable location on the side panels 24, 26 and/or the rear panel 28, or may not be used at all.

The base 22 is preferably rectangular, having a length ranging from 100 to 150 inches, more preferably 120 to 130 inches, or 125 inches, and a width ranging from 75 to 100 inches, more preferably 88 to 96 inches. A typical air cargo container has a length of 125 inches and a width of 88 inches. The base 22 may be similar to an aluminum pallet traditionally used for the stacking and movement of materials by a forklift. In such a case, the base 22 is formed to accommodate the forks of a forklift so that the air cargo container 20 may be picked up and transported by a conventional forklift. Alternatively, as illustrated in the drawings, the base 22 may simply be a flat hollow pallet or a slab.

Figure 6:
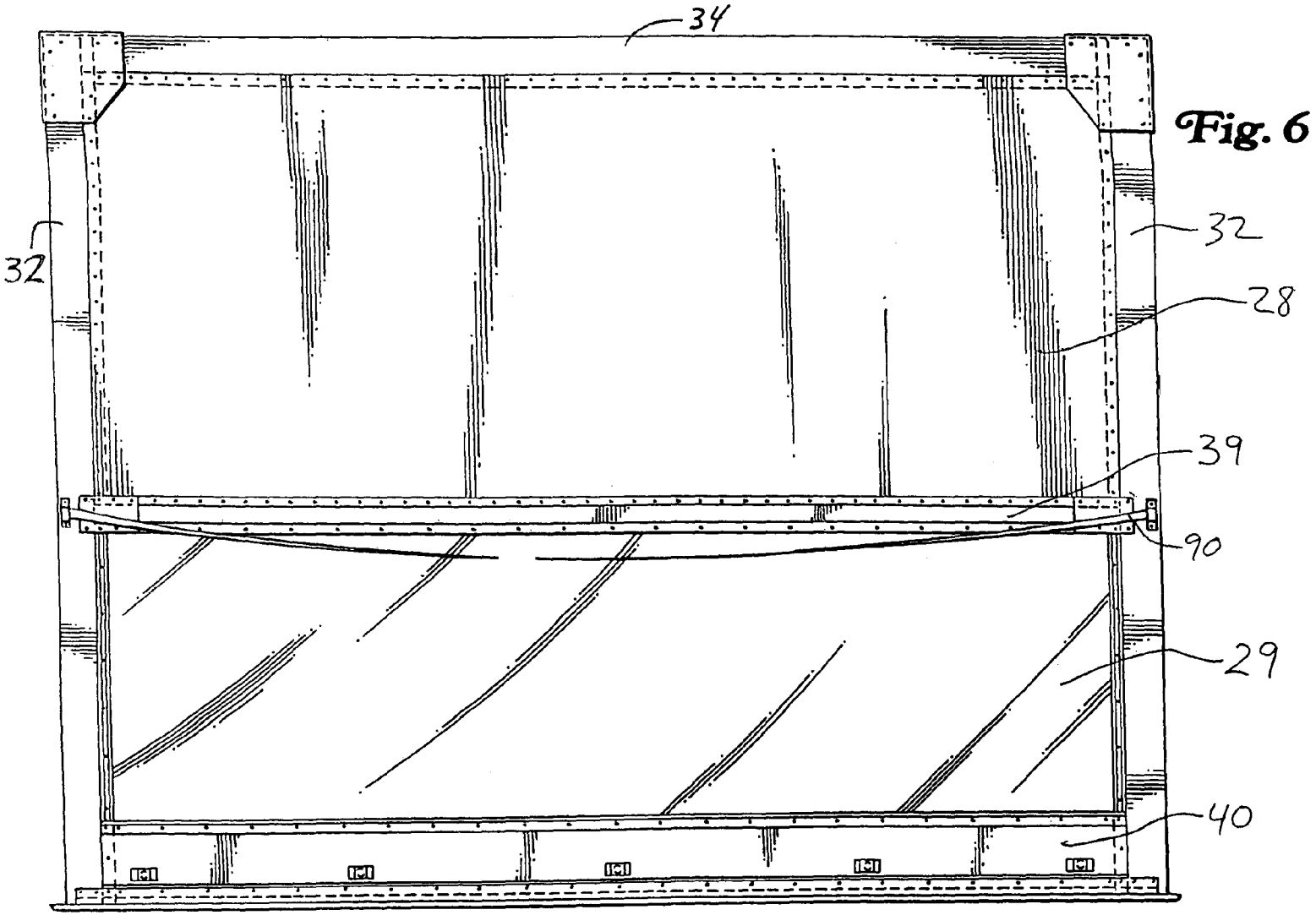
FIG. 6 is a rear view of the air cargo container taken along lines 6—6 in FIG. 5.

A pair of corner posts or upright supports 32 are located at the rear corners of the base 22. A cross member 34 extends between the top portions of the upright supports 32 as shown in FIG. 6. The first and second side walls 24, 26 and the rear wall 28 are attached to the upright supports 32. The rear wall 28 is further attached to the cross member 34. The first and second side walls 24, 26 and the rear wall 28 each preferably have a height of approximately 90 to 96 inches, more preferably 92 to 94 inches.

In embodiments where one or more transparent sheets 25, 27, 29 are used, cross members 35, 37, 39 are preferably positioned between the aluminum sheets and the transparent sheets to provide additional structural support. Cross members 36, 38, 40 may also be included along the sides and rear of the base 22 to provide additional structural support.

The first and second side panels 24, 26 each have a curved front edge. The radius of curvature of the front edge of the first and second side panels 24, 26 is selected to fit closely within the curvature of the interior fuselage or cargo section of an aircraft. Accordingly, a maximum number of air cargo containers 20 can be loaded into and transported in a cargo plane, while minimizing wasted space in the cargo area.

A roof panel 42 is preferably attached between upper portions of the first and second side panels 24, 26 and the rear cross member 34. The roof panel 42 preferably ends approximately where the curvature of the first and second side panels 24, 26 begins. Thus, the roof panel 42 is preferably substantially flat, and does not require a substantial curved portion.

A first support member 50 is preferably attached along the curved front edge of the first side wall 24, and a second support member 52 is preferably attached along the curved front edge of the second side wall 26. Thus, the first and second support members 50, 52 have a curvature that matches the curvature of the first and second side walls 24, 26. Each of the first and second support members 50, 52 is preferably approximately 10 to 13 inches wide, more preferably 11 to 12 inches wide. The dimensions provided here and above are examples. Of course, the precise dimensions of any feature described are not material to the invention.

As shown in FIG. 7, a first door frame extrusion 54 is preferably attached along a curved inner edge of the first support member 50. Similarly, a second door frame extrusion 56 is preferably attached along a curved inner edge of the second support member 52. Thus, the first and second door frame extrusions 54, 56 have a curvature that matches the curvature of the first and second support members 50, 52 and the first and second side walls 24, 26. Each of the first and second door frame extrusions 54, 56 is preferably approximately 1 to 4 inches wide, more preferably 2 to 3 inches wide.

A retractable or roll-up door 60 is positioned between the first and second door frame extrusions 54, 56. The door 60 is made of a sturdy flexible material, such as nylon, polyester, cloth, or another suitable material. The retractable door 60 is preferably supported on a spool or roller 62. The roller 62 is preferably spring-biased for retracting the door 60 in a manner similar to that of a roll-up window shade, except that the spring preferably exerts a constant tension on the door 60 so that there are no intermediate stopping positions. Intermediate stopping positions may bemused, however, if desired. The roller 62 is preferably supported on an upper portion of the first and second door frame extrusions 54, 56, or at another suitable location, such as underneath the roof panel 42.

The retractable door 60 preferably includes a steel cable 64 or similar tension element located along each vertical side edge of the door 60. Each cable 64 is preferably sewn into the door material (as is best illustrated in FIG. 8) and extends the entire length of the side edge. Additionally, one or more steel cables 64 are preferably sewn into the body of the door 60, as illustrated in phantom in FIGS. 3, 4, and 7, to provide strength and/or moderate stiffness to the door 60. Substitutes such as flexible rods, springs, links, chains, segmented elements, etc., of various materials, may be used in place of the cables. The term "cable" as used here includes all such elements. A preferred flexible door having one or more cables sewn into the side edges and body of the door is described in U.S. Pat. No. 4,538,663, incorporated herein by reference.

A door bar 70 is preferably attached to a leading edge of the flexible door material. The bar 70 is preferably attached to the door 60 with a bracket or similar structure into which a plastic rod sewn into the door 60 is inserted. A hard rubber weather strip is preferably attached to the bottom edge of the bar 70. Thus, when the door 60 is in the closed position, the weather strip seals against the container base 22 to help weather proof the bottom side of the door 60 as described in U.S. Pat. No. 4,538,663.

The bar 70 is preferably securable to a lower region of each of the first and second door frame extrusions 54, 56 to securely close the door 60. The bar 70 preferably includes flat end plates on each end for engaging a button or similar structure on each of the first and second door frame extrusions 54, 56, as described in U.S. Pat. No. 4,538,663. The bar 70 may alternatively be securable to the base 22, or to the first and second support members 50, 52, or to the first and second side walls 24, 26. Additionally, or alternatively, locking pins, as described in U.S. Pat. No. 5,601,201, incorporated herein by reference, may be used to the lock the door in the down or closed position. Other known air cargo container closures may alternatively be used.

Referring to FIGS. 7 and 8, the first door frame extrusion 54 (which is preferably a mirror image of the second door frame extrusion 56) includes a channel 80 running along substantially its entire length. The channel 80 is defined by an inner channel wall 82 and an outer channel wall 84. When the door 60 is pulled down into a closed position, the channel 80 receives and guides the cable 64 on the corresponding side edge of the door 60.

Levers 86 or similar retaining devices are positioned along the curved section of the door frame extrusions 54, 56. In a preferred embodiment, three levers 86 are positioned along the curved section of each of the first and second door frame extrusions 54, 56. Each lever 86 is preferably secured to one of the door frame extrusions 54, 56, by a screw or bolt 92 threaded into a nut 90 or similar structure. The lever 86 is preferably pivotable 90°, from an open position to a closed position. Alternatively, the lever may be pivotable 180°, or a full 360°.

When the lever 86 is rotated into the closed position, a head 88 on the lever 86 is positioned over the inner channel wall 82 to secure the cable 64 within the channel. The lever head 88 preferably rotates over the cable 64 and holds the cable 64 within the channel 80.

The levers 86 are preferably included to prevent the flexible door from folding or collapsing into the air cargo container 20, and from pulling the cables 64 out of the channels 80, during closing of the door 60. If the door 60 collapses into the container 20, it can be difficult or time consuming for one person to pull the door 60 out and re-align it, due to the weight and flexible nature of the door. However, in some applications, the levers 86 may not be essential and can be omitted or not used.

Figure 1:
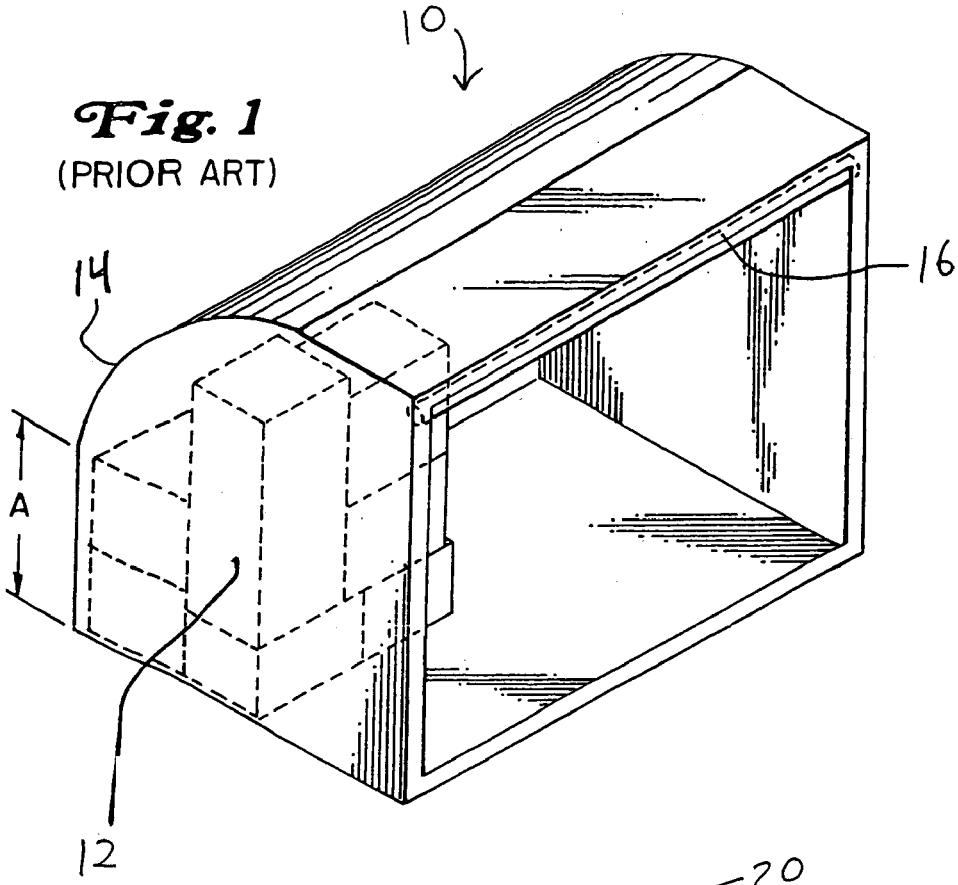
Fig. 1 (PRIOR ART)
FIG. 1 is a perspective view of a prior art air cargo container.
Figure 10:
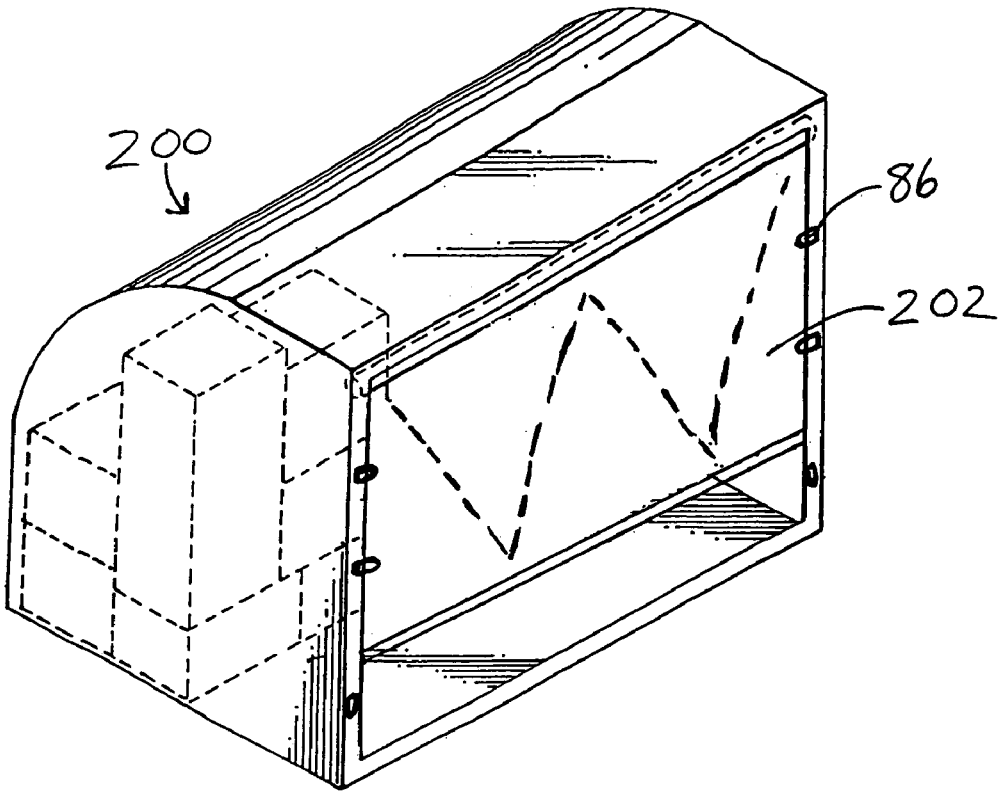
FIG. 10 is a perspective view of an air cargo container according to an alternative embodiment.

Once the door 60 has been pulled past the curved sections, the door 60 needs only to be pulled straight down vertically, with the aid of gravity. Accordingly, levers 86 are not necessary to secure the cables 64 in the channels 80 below the curved sections of the first and second door frame extrusions 54, 56. Levers 86 may be included at these lower sections, however, if desired to further secure the cables 64 within the channels 80. In an alternative embodiment, as illustrated in FIG. 10, levers 86 may be used on a conventional container 200, such as the prior art container 10 shown in FIG. 1, to secure the vertical door 202 at the rear of the container into door rails or channels.

In use, one or more operators, i.e., airfreight or airline employees or other persons, load cargo items 30 into an open container 20, such as the container 20 illustrated in FIG. 2. The cargo 30 may be loaded manually and/or via a forklift or other loading device. The cargo 30 is loaded and stacked against the interior surface of the rear wall 28 of the container 20 until the rear wall 28, up to or near the roof 42. Additional cargo 30 is then loaded into the air cargo container 20 until the container 20 is substantially filled with cargo 30.

When an operator observes that the air cargo container 20 is substantially filled with cargo 30, the operator may optionally pull the retractable door 60, via the bar 70, part way down along the curved portion of the first and second door frame extrusions 54, 56. By doing this, the operator can use the door bar at a template, to readily determine whether more room exists in the curved area of the container 20 to load additional items 30, or whether too many items 30 have been loaded and are blocking the door path, in which case some items 30 must be removed from the container 20. The operator may then allow the door 60 to retract onto the roller 62 so that the operator may load and/or unload cargo items 30, or the operator may continue the process of closing the door 60.

Figure 3:
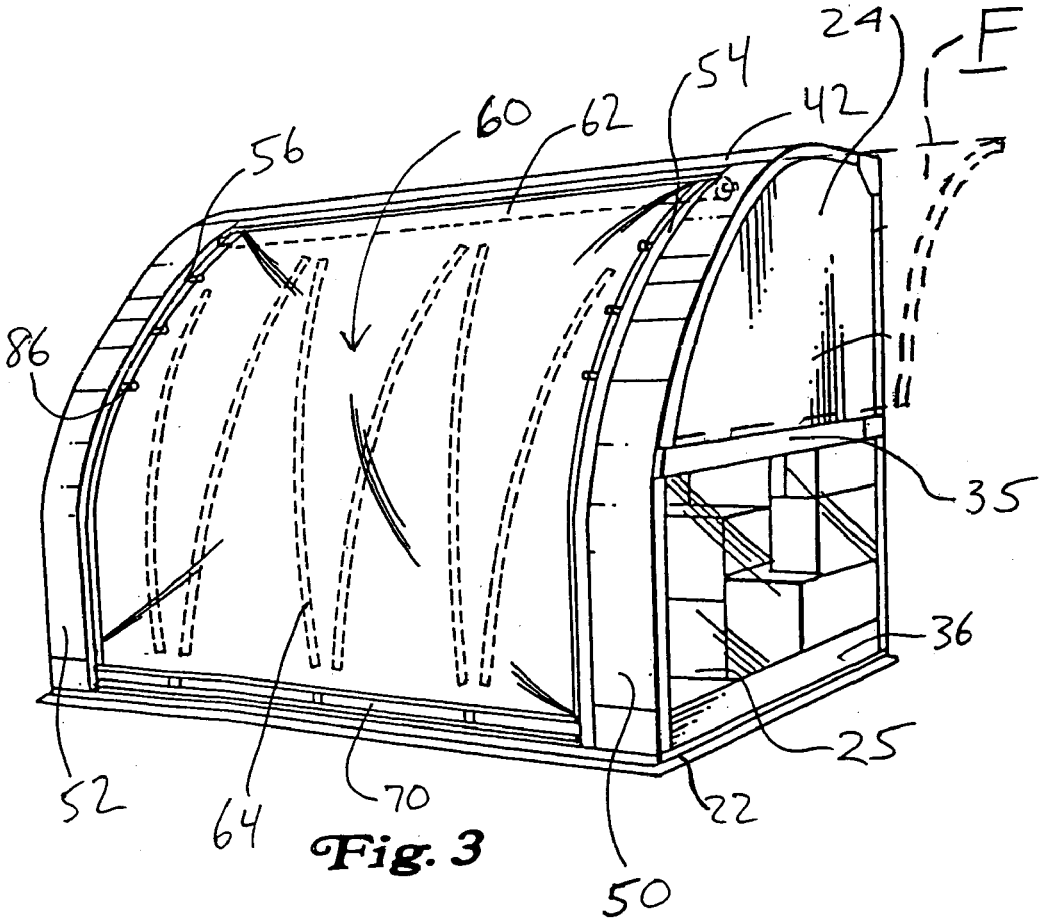
FIG. 3 is a perspective view of the air cargo container of FIG. 2 with the retractable door in a closed position.

Once the air cargo container 20 is filled to a desired capacity, the operator pulls the door 60 down, by the bar 70, along the first and second door frame extrusions 54, 56 past the first pair of levers 86 positioned on either side of the door 60. While the door 60 is pulled down along the first and second door frame extrusions 54, 56, the cables 64 at the side edges of the door 60 are guided within the channels 80 in the first and second door frame extrusions 54, 56. The operator then rotates the first pair of levers 86 on either side of the door 60, so that the levers 86 cover the cables 64 and secure the cables 64 within their corresponding channels 80, as is best illustrated in FIG. 8. The levers preferably have sufficient friction so that they remain in whatever position they are placed. Referring to FIGS. 2 and 3, the support members 50, 52 and door frame extrusions 54, 56 form or define a curved flat plane F, shown in dotted lines in FIG. 3. The levers 86, or equivalent retaining devices, retain the sides of the door in the channels, to maintain the door generally in or parallel to the plane F, as the door is closed.

After the cables 64 are secured into the channels 80 by the first pair of levers 86, the operator pulls the door 60 down farther along the first and second door frame extrusions 54, 56 past the second pair of levers 86 on either side of the door 60. The operator rotates the second pair of levers 86 on either side of the door 60, so that the levers 86 cover the cables 64 and secure the cables 64 within their corresponding channels 80. This process is then repeated for each additional pair of levers 86 positioned on either side of the door 60. As stated above, three pairs of levers 86 are preferably used to adequately secure the cables 64 within the channels 80, but any other suitable number of levers 86 may alternatively be used. Alternatively, the levers may be omitted.

Once the door 60 has been pulled down past the curved portions of the first and second door frame extrusions 54, 56, and the cables 64 have been secured into their respective channels 80, the operator pulls the door 60 down along the remaining vertical portion of the first and second door frame extrusions 54, 56. When the bar 70 on the door 60 reaches the base 22 of the container 20, the operator latches and optionally locks the door 60 into the down and closed position, as described above and in U.S. Pat. No. 4,538,663, or via any of various other equivalent mechanisms.

After the door 60 is closed, the air cargo container 20 may be loaded into an aircraft or other vehicle by a forklift, a conveyor mechanism, and/or another loading device. When loaded into an aircraft, the curvature of the front end of the air cargo container 20, including the door 60, substantially matches the curvature of the interior of the fuselage or cargo area of the aircraft. Accordingly, a maximum number of air cargo containers 20 may be loaded into the aircraft, such that minimal space is wasted in the cargo area of the aircraft.

When the air cargo container 20 arrives at its destination, the container 20 is opened by releasing and/or unlocking the door 60 and allowing the door 60 to retract along the first and second door frame extrusions 54, 56 up to the lowest pair of levers 86. An operator then rotates the lowest pair of levers 86 to an open position and allows the door 60 to be retracted up to the next pair of levers 86. The process of opening levers 86 is repeated for each additional pair of levers 86, and the door 60 is then allowed to completely retract onto the roller 62. The cargo items 30 may then be unloaded from the air cargo container 20, either manually and/or via a forklift or other unloading device.

The air cargo container 20 provides several advantages over existing flexible door containers. First, the entire door-closing process for the air cargo container 20 requires approximately 30 to 50 seconds to perform, versus the three to four minutes that are generally required to close a container using the flap door design. Second, the door 60 is fully retractable onto the roller 62, so that the door 60 does not flap around in the wind during loading and unloading of the air cargo container 30.

Third, because the door 60 is sturdy and supported by one or more cables 64, cargo items 30 can shift against the door 60 during transport without making it difficult to later open the door 60. Fourth, because the door 60 is continuous and the door bar 70 is rigid, it acts as a template for the curvature of an aircraft fuselage. Accordingly, the air cargo container 20 can readily be loaded substantially to its maximum capacity, without concern that cargo items 30 will protrude through the door 60 and inhibit loading of the container 20 into an aircraft. In addition, all loading, door closing, door opening, etc. operations of the container 20 can be performed by a single operator.

Figure 9:
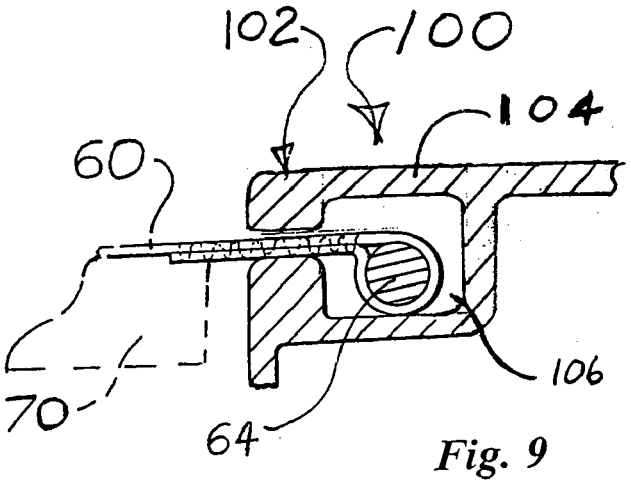
FIG. 9 is a section view of an alternative design.
Figure 4:
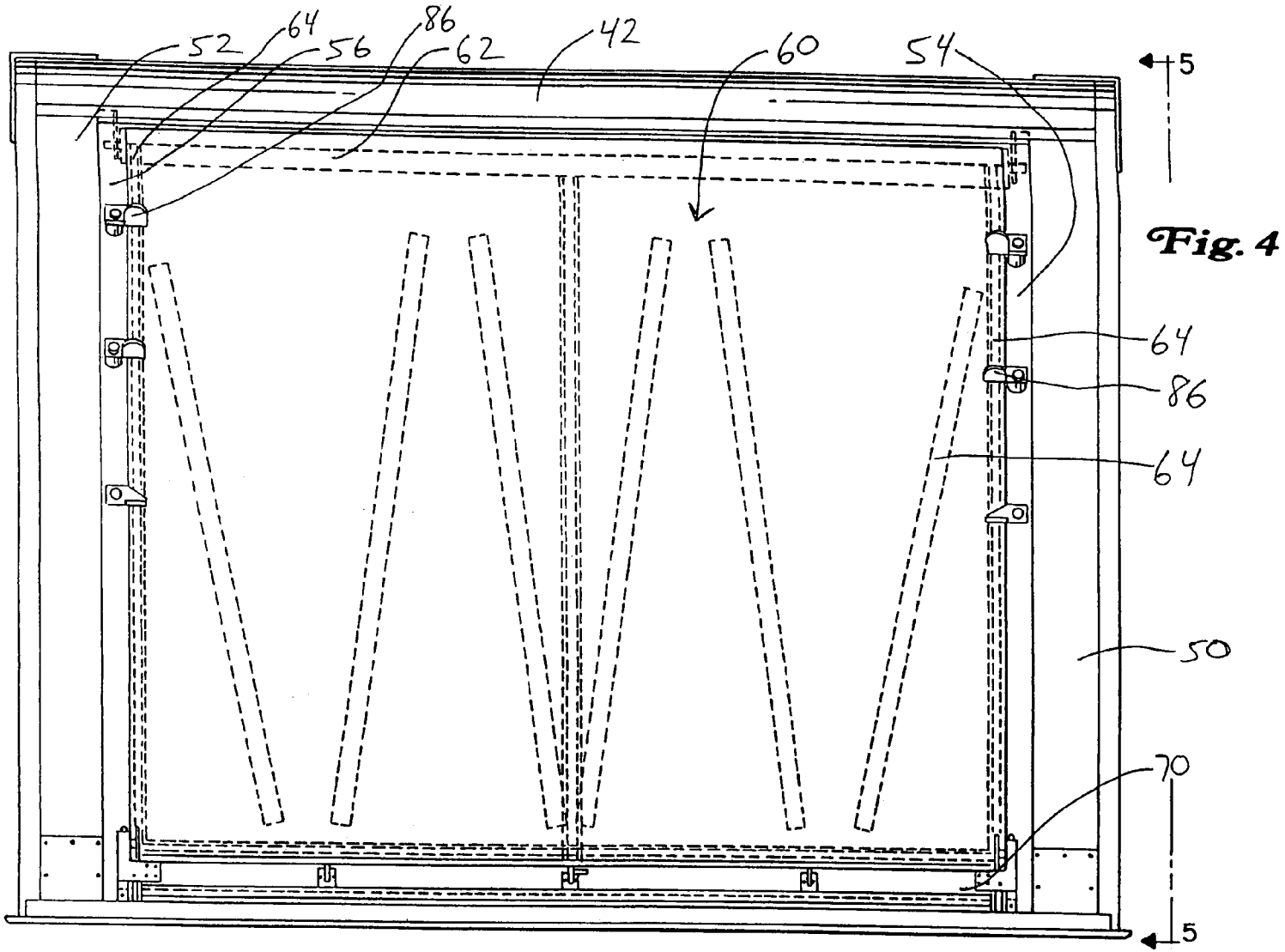
FIG. 4 is a front view of the air cargo container of FIGS. 2 and 3 with the retractable door in the closed position.

As shown in FIG. 9, in an alternative design 100, the cables 64 at the side edges of the door 70 are permanently captured in channels 106 of a door frame 102 (preferably an extrusion) having a cover 104. The cover 104 prevents the cables or door edges from pulling out of channels 80. The door bar 70 is shortened so that it fits between the left and right side door frames. Since the door edges are captive in the channels, no levers are needed.

Figure 5:
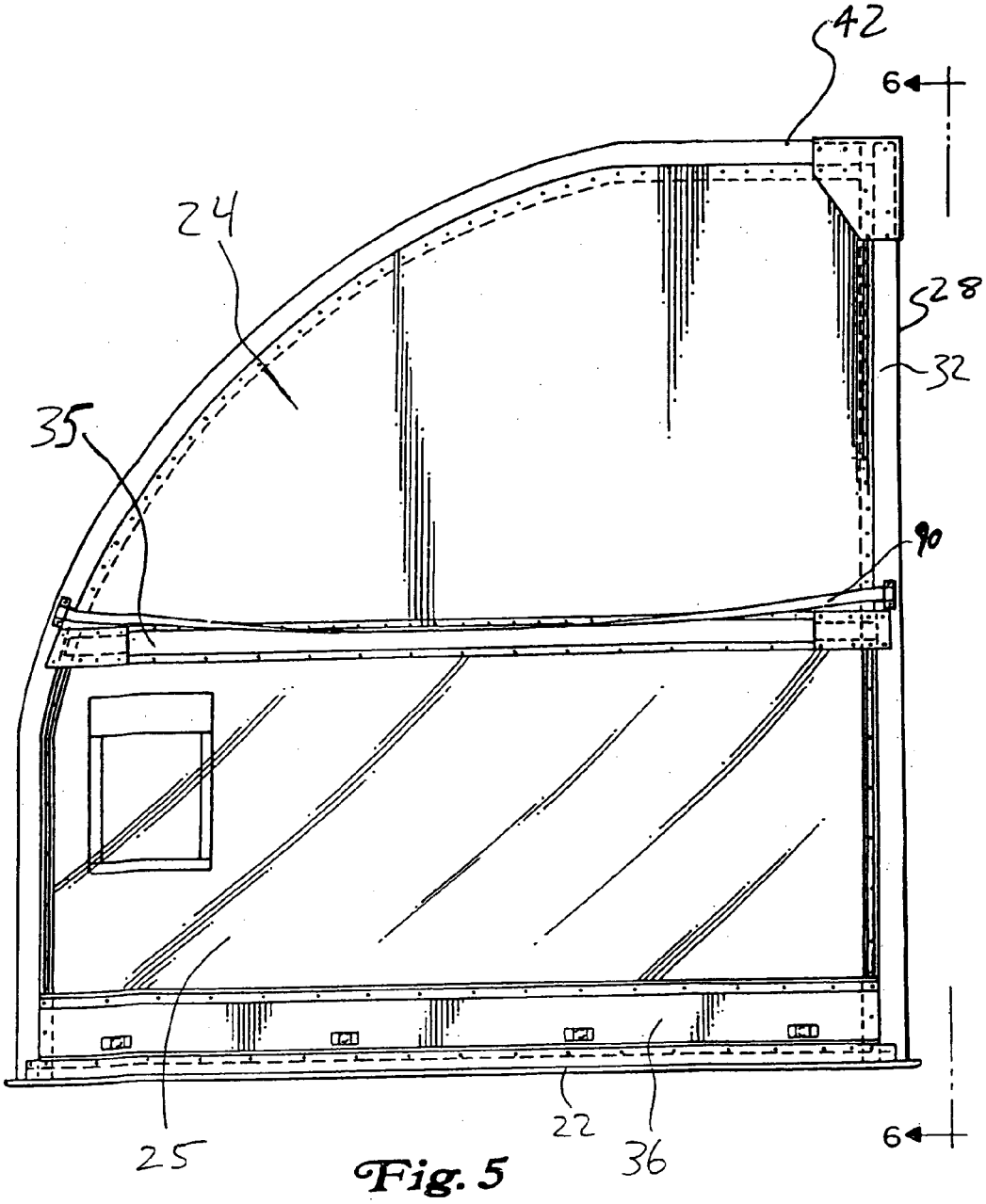
FIG. 5 is a side view of the air cargo container taken along lines 5—5 in FIG. 4.

While preferred embodiments have been shown and described, alternative and/or additional embodiments may be used without departing from the scope of the invention. For example, the first and second door frame extrusions 54, 56 may be eliminated and the door 60 may be guided along channels in the first and second support members 50, 52, or along the front edges of the first and second side walls 24, 26. Additionally, straps 90, as illustrated in FIGS. 5 and 6, may be included on the side walls 24, 26 and/or the rear wall 28 of the air cargo container 20 to allow an operator or machine to pull the air cargo container 20 along a surface. Other modifications and/or additions may also be made. The invention, therefore, is not to be restricted except by the following claims and their equivalents.

What is claimed is:

1. A cargo container, comprising:

a base;

a first side wall attached to the base and having a curved front edge;

a second side wall attached to the base and having a curved front edge;

a rear wall attached to the base and attached to a rear edge of each of the first and second side walls;

a flexible retractable door between the first and second side walls, with the door moveable along the curved front edge of the first and second side walls to a position adjacent to the base;

a support member attached along the curved front edge of each of the first and second side walls, each support member including a channel for receiving a side edge of the retractable door;

a cable attached to each side edge of the retractable door, wherein the channel in each support member is configured to receive one of the cables to secure the cable in the support member; and at least one pivotable lever on each of the support members, wherein each lever is movable from an open position to a closed position in which the lever secures the cable within the channel in the support member.

2. The cargo container of claim 1 further comprising a door frame extrusion on an inner section of each of the support members, wherein the channels are formed in the door frame extrusions.

3. The cargo container of claim 1 further comprising a door bar attached to a leading edge of the door, wherein the bar is securable to at least one of the side walls, the base, and the support members for maintaining the door in the closed position.

4. The cargo container of claim 1, wherein the door is a roll-up door.

5. The cargo container of claim 4 wherein the door has a cable at each of its side edges, and with each cable captive within the first or second side wall.

6. The cargo container of claim 1 with the first and second side walls each having a straight section extending from the base up to the curved edge.

7. The cargo container of claim 1 wherein the rear wall is flat.

8. A cargo container, comprising:

a base;

a first side wall attached to the base;

a second side wall attached to the base;

a rear wall attached to the base and attached to the first and second side walls;

a first support member attached to the first side wall and having a first curved front surface including a first channel;

a second support member attached to the second side wall and having a second curved front surface including a second channel;

a retractable door between the first and second side walls, with the door moveable along the curved front surfaces to a position adjacent to the base;

first and second cables attached to each side respectively of the retractable door, with the first and second channels configured to receive the first and second cables; and at least one pivotable lever on each of the first and second support members, with the levers movable from an open position to a closed position where the levers secure the cables within the channels.

9. A cargo container, comprising:

a base;

a first side wall on the base;

a second side wall on the base;

a generally flat rear wall on the base and attached to the first and second side walls;

a first support member attached to the first side wall and having a curved front surface including a first channel;

a second support member attached the second side wall and having a curved front surface including a second channel;

a roll-up door having a first cable and a second cable, and with the door moveable from an open position where the door is rolled up, to a closed position where the door is at least partially unrolled and the first cable is positioned in the first channel and the second cable is positioned in the second channel; and at least one lever on each of the first and second support members, wherein each lever is movable from an open position to a closed position in which the lever secures one of the first and second cables within the corresponding first and second channel, respectively.

10. The cargo container of claim 9 further comprising a bar attached to a leading edge of the door, wherein the bar is securable to a lower portion of each of the first and second support members for maintaining the door in the closed position.

11. The cargo container of claim 10 further comprising means for locking the door into the closed position.

12. The cargo container of claim 9 further comprising door retaining means for keeping the door substantially parallel to with the curved front surface of the first and second supports.

13. The cargo container of claim 9 further comprising a door frame extrusion on an inner section of each of the first and second support members, wherein the first and second channels are formed in the door frame extrusions.

* * * * *